US005255660A

United States Patent [19]

Vogel et al.

[11] Patent Number: 5,255,660

[45] Date of Patent: Oct. 26, 1993

[54] SEMICONDUCTOR SWITCH, IN PARTICULAR AS A HIGH-VOLTAGE IGNITION SWITCH FOR INTERNAL COMBUSTION ENGINES

[75] Inventors: Manfred Vogel, Ditzingen/Heimerdingen; Werner Herden, Gerlingen, both of Fed. Rep. of Germany

[73] Assignee: Robert Bosch GmbH, Stuttgart, Fed. Rep. of Germany

[21] Appl. No.: 777,543

[22] PCT Filed: Feb. 23, 1990

[86] PCT No.: PCT/DE90/00123

§ 371 Date: Nov. 20, 1991

§ 102(e) Date: Nov. 20, 1991

[87] PCT Pub. No.: WO90/15242

PCT Pub. Date: Dec. 13, 1990

[30] Foreign Application Priority Data

Jun. 2, 1989 [DE] Fed. Rep. of Germany ..... 3917968

[51] Int. Cl.[5] ..... F02P 3/12

[52] U.S. Cl. ..... 123/643; 307/110

[58] Field of Search ..... 123/643, 620, 628, 605, 123/594, 651; 328/78; 307/110

[56] References Cited

U.S. PATENT DOCUMENTS

| | | | |
|---|---|---|---|
| 4,554,622 | 11/1985 | Mommsen et al. | 307/110 |
| 4,881,512 | 11/1989 | Erskine et al. | 123/628 |
| 4,992,922 | 2/1991 | Ishimura et al. | 307/110 |
| 4,992,923 | 2/1991 | Mitsuya et al. | 307/110 |
| 5,002,034 | 3/1991 | Herden et al. | 123/643 |
| 5,008,798 | 4/1991 | Harvey | 307/110 |
| 5,009,213 | 4/1991 | DiNunzio et al. | 123/620 |
| 5,060,623 | 10/1991 | McCoy | 123/605 |

FOREIGN PATENT DOCUMENTS

| | | |
|---|---|---|
| 3731412 | 5/1988 | Fed. Rep. of Germany . |
| 1247459 | 10/1960 | France . |

OTHER PUBLICATIONS

Marcus-Electronic Circuits Manual-1971, p. 298, "Flash-Triggered Series-SCR High-Voltage Switch".

*Primary Examiner*—E. Rollins Cross

*Attorney, Agent, or Firm*—Frishauf, Holtz, Goodman & Woodward

[57] ABSTRACT

The invention relates to a semiconductor switch, in particular as an ignition voltage switch for applying an ignition voltage to a spark plug of an internal combustion engine, having a cascade circuit formed of series-connected semiconductor components for connecting an operating voltage through to a load, wherein the semiconductor components each have a depletion-layer capacitance, and the connection existing between each two semiconductor components forms a parasitic ground capacitance determined by the electrical field distribution. For symmetrical voltage distribution without additional wiring elements, it is provided that a breakover current ($i_k$) flowing through the semiconductor components ($T_1$-$T_n$) prior to attainment of the conductive state is located, relative to a displacement current ($i_{ver}$), within the range $i_{ver} < i_k < a \cdot i_{ver}$, wherein the displacement current ($i_{ver}$) is brought about by a voltage increase ($du_o/dt$) in the operating voltage $u_o$ at the depletion-layer ($C_1$) and ground ($C_2$) capacitances of the cascade circuit which vary as the semiconductor components become conducting, and the factor (a) has a value between 5 and 10.

16 Claims, 2 Drawing Sheets

SEMICONDUCTOR SWITCH, IN PARTICULAR AS A HIGH-VOLTAGE IGNITION SWITCH FOR INTERNAL COMBUSTION ENGINES

FIELD OF THE INVENTION

The invention relates to a semiconductor switch, in particular as an ignition voltage switch for applying an ignition voltage to a spark plug of an internal combustion engine, having a cascade circuit formed of semiconductor components for connecting an operating voltage through to a load.

BACKGROUND

In high-voltage semiconductor switches it is known to make a cascade circuit (series circuit) of semiconductor components, to assure their electric strength. Accurate dimensioning of the semiconductor components' wiring elements, necessary for the preferably uniform voltage distribution, is important, since if the depletion voltage limit values are exceeded, destruction of the semiconductors ensues. The known wiring elements are made with relative complicated resistor-capacitor networks. This avoids uneven voltage distribution caused by deviations from one component to another and unavoidable stray capacitances. Because of the wiring elements, the circuit layout is relatively complicated and expensive.

German Patent Disclosure Document DE-OS 37 31 412 and corresponding U.S. Pat. No. 5,002,034, HERDEN, BENEDIKT & KRAUTER, discloses a high-voltage switch equipped with phototransistors, in which one resistor is connected parallel to each transistor. The thus-formed voltage divider serves to provide uniform distribution of the operating voltage to be switched. Aside from the already mentioned disadvantages of such wiring elements, the current flowing through the voltage divider also causes undesirable losses.

THE INVENTION

The device according to the invention has the advantage over the prior art that no wiring elements have to be used, yet nevertheless a maximally symmetrical voltage distribution is achieved. The circuitry expense is decisively lowered thereby, and no additional voltage control losses occur. Each of the series-connected semiconductor components of the cascade circuit has a depletion-layer capacitance, and because of the prevailing electrical field distribution, the connection existing between each two semiconductor components forms a corresponding (parasitic) capacitance to ground. These capacitances, known per se, are unavoidable and therefore have nothing in common with the wiring elements known from the prior art. The reason they are used for the symmetrical wiring distribution of the semiconductor switch according to the invention is that they bring about a displacement current, by means of an increase in the operating voltage. According to the invention, it is provided that relative to the displacement current, a breakover current flowing through the semiconductor components before the conducting state is attained is located within the range $$i_{ver} < i_K < a \cdot i_{ver},$$

where $i_{ver}$ is the displacement current, $i_K$ is the breakover current, and a is a factor the value of which is between approximately 5 and 10. Upon successive switching of the various series-connected semiconductor components, the aforementioned capacitances of the cascade circuit accordingly vary successively as well. Various options exist for putting the teaching of the invention into practice, each of which can be used alone or in combination with others. The most important option is to predetermine the magnitude of the breakover current in such a way, by the selection of the semiconductor components, or in their manufacture, that the condition according to the invention is met. Another factor can be the setting of the depletion-layer capacitance of the semiconductors used. Moreover, the various capacitances to ground can be varied within certain limits by the layout of the cascade. Finally, the displacement current is also determined by the speed of increase in the operating voltage, so that can be a factor as well. The aforementioned magnitudes or quantities should therefore be adapted to one another in such a way that the condition according to the invention is adhered to. In practice, it can be assumed that both the depletion-layer capacitance and the ground capacitance are defined within relatively narrow limits. The speed of increase in the operating voltage is also usefully defined within narrow limits by external circumstances that are not directly related to semiconductor switches. For instance, the speed of voltage increase is often defined by customer specifications. Accordingly, to the extent that the speed of voltage increase is predetermined by the external circumstances, it cannot be a factor in putting the teaching of the invention into practice.

Accordingly—as already noted above—the component-dependent specification of the breakover current remains as an important factor. The term "breakover current" is understood to be the current of the semiconductor component that flows shortly before the component reaches its conducting state. The breakover voltage, which is associated with the breakover current and corresponds to the ignition voltage that leads to the switching of the semiconductor, is present at the semiconductor component while it is still in its blocked state. If accordingly a voltage increase up to the ignition voltage occurs, then the semiconductor assumes its conducting state. The low breakover current flowing previously then changes into the conducting current (operating current). According to the teaching of the invention, the limits of the breakover current result from the necessity of preventing any semiconductor component of the cascade from becoming conducting before the breakover voltage and thus the breakover current is attained at the semiconductor component on the output side, leading to the load. On the other hand, it is true that shortly before the semiconductor becomes conducting, an overly high transfer from the input of the cascade to the load should be avoided; that is, an overly large voltage buildup and/or an overly high power loss at the load is undesirable.

It is preferably provided that the displacement current result from the depletion-layer capacitance $C_1$ of the semiconductor component located on the output side of the cascade and leading to the load and from the capacitance $C_2$ to ground, in accordance with the equation $$i_{ver} = (C_1 + C_2)\frac{du_o}{dt}.$$

The voltage increase ensues until the ignition voltage of the semiconductor components, at which they become conducting. This is known as "overhead ignition", if the ignition process takes place without additional triggering or the like. If the semiconductor component is a thyristor, for instance, then an overhead ignition is involved if the anode-to-cathode voltage is increased up to the zero breakover voltage, at which the semiconductor changes to its conducting state, without triggering of the gates.

In the semiconductor switch according to the invention, however, components with control terminals can also be used, so that the through-connection can be brought about by triggering these control terminals.

Each semiconductor component is preferably embodied as a thyristor, photothyristor or trigger diode.

DRAWING

The invention will be described in further detail below in conjunction with the drawing. Shown are:

FIG. 1, a schematically shown cascade of the high-voltage switch equipped with semiconductor components, with a load connected to it;

FIG. 2, a diagram of the operating voltage; and

FIG. 3, a current/voltage diagram for a semiconductor component.

DETAILED DESCRIPTION OF THE PREFERRED EMBODIMENT

Figure 1:
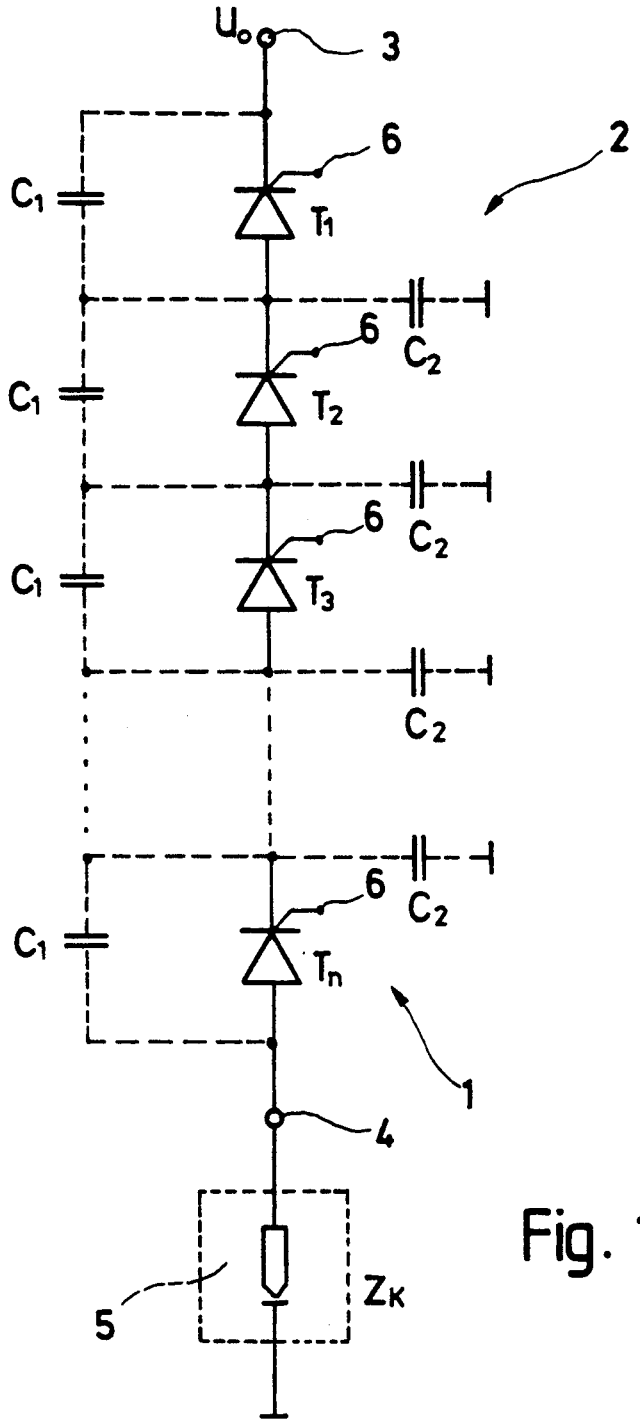

FIG. 1 shows a series circuit of a plurality of thyristors $T_1$–$T_n$. They form a cascade 1 of the high-voltage switch 2 according to the invention. One end of the series circuit forms an input 3, and the other end forms an output 4 of the high-voltage switch 2. A depletion-layer capacitance $C_1$ is located parallel to each thyristor $T_1$–$T_n$. The magnitude of the depletion-layer capacitance $C_1$ can be varied within certain limits in the manufacture of the semiconductor. It can be assumed in practice that the depletion-layer capacitances $C_1$ of the thyristors $T_1$–$T_n$ do not all have the same capacitance, because of variations from one thyristor to another.

The connections existing between each two semiconductor components $T_1$–$T_n$ are connected to a parasitic ground capacitance $C_2$ determined by the electrical field distribution.Depending on the structural layout of the cascade 1, the magnitude of these ground capacitances $C_2$ can be varied within certain limits. The magnitude of the various ground capacitances $C_2$ can be varied as a function of the location within the cascade; if the cascade 1 has a symmetrical layout, however, it is possible for all the ground capacitances $C_2$ to have approximately the same value.

Both the depletion-layer capacitances $C_1$ and the ground capacitances $C_2$ are unavoidable, parasitic capacitances, not additional wiring elements of the kind known in the prior art. They are represented by dashed lines in FIG. 1 to make this distinction clear.

The operating voltage $u_o$ is applied to the input 3 of the cascade 1, and a load 5 is connected to its output 4. The high-voltage switch is preferably used as an ignition-voltage switch for applying an ignition voltage to a spark plug of an internal combustion engine. In that case the operating voltage $u_o$ is the secondary voltage of an ignition coil, and the load 5 is a spark plug $Z_K$. In the exemplary embodiment shown, the applicable gate 6 of the thyristors $T_1$–$T_n$ is not wired. That means that the thyristors $T_1$–$T_n$ assume their conducting state when the anode-to-cathode voltage exceeds a predetermined limit value (zero breakover voltage) $U_{K0}$. If a triggering of the gates 6 occurs—in an exemplary embodiment that is not shown—then there is a dependency of the ignition voltage of the thyristors $T_1$–$T_n$ on the control current flowing at that time. The following description, however, applies to the nontriggered embodiment shown in FIG. 1.

Figure 2:
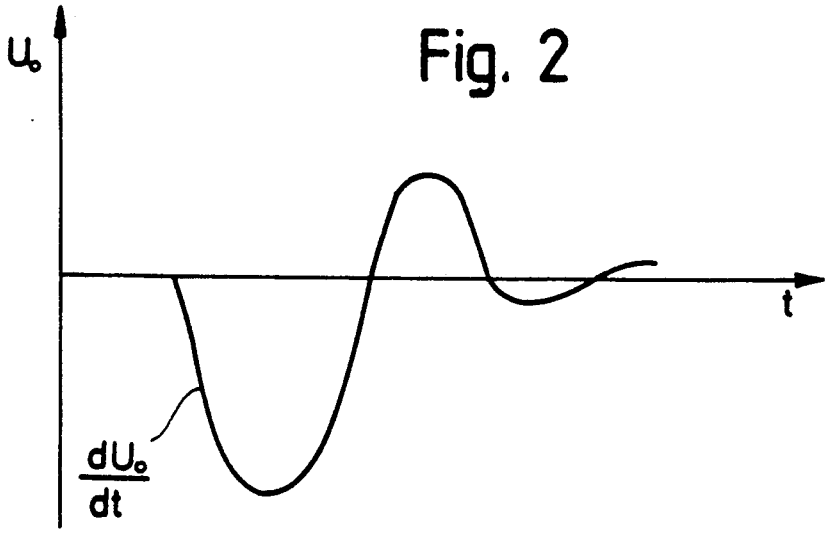

FIG. 2 shows the course of the secondary voltage (operating voltage $u_o$) of an ignition coil, not shown. The negative half-wave has one edge having the speed $du_o/dt$ of the voltage increase.

Figure 3:
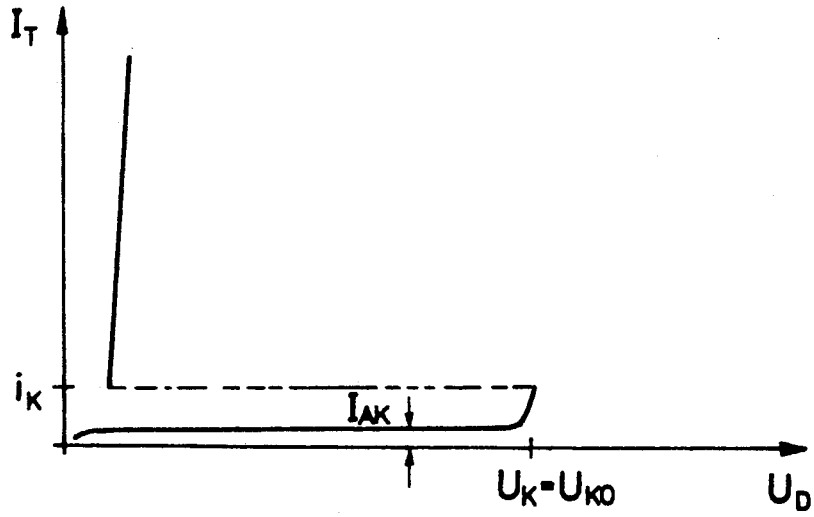

FIG. 3 shows the current/voltage diagram of one of the thyristors $T_1$–$T_n$. What is shown is the on-state or switching quadrant of the diagram. As the anode-to-cathode voltage $U_D$ increases, the current initially increases virtually imperceptibly; instead, it is limited to the blocking current $I_{AK}$. If the breakover voltage $u_K$ is attained, then the current abruptly increases to the breakover current $I_K$ and then abruptly changes over to the on-state current $I_T$. Since the gates 6 of the thyristors $T_1$–$T_n$ are not triggered (FIG. 1), the breakover voltage $u_K$ is the zero breakover voltage $U_{KO}$.

According to the invention, it is now provided that for uniform distribution of the secondary voltage (operating voltage $u_0$) among the thyristors $T_1$–$T_n$, a breakover current $i_K$ flowing prior to attainment of the conducting state of the thyristors $T_1$–$T_n$ is located, relative to a displacement current $i_{ver}$, within the range $$i_{ver} < i_k < a \cdot i_{ver},$$

where the factor a assumes a value between approximately 0 and 10. The teaching according to the invention assures that substantially uniform distribution of voltage for the various cascade elements takes place, even without additional wiring elements and despite variations from one semiconductor to another, so that the electric strength of the various thyristors $T_1$–$T_n$ is not exceeded.

For the displacement current, the following equation $$i_{ver} = (C_1 + C_2)\frac{du_o}{dt}$$

applies, resulting in the equation $$(C_1 + C_2)\frac{du_o}{dt} < i_k < a\,(C_1 + C_2)\frac{du_o}{dt}.$$

The high-voltage switch 2 according to the invention functions as follows:

By suitable triggering of the ignition coil, not shown, the voltage course shown in FIG. 2 is applied to the input 3 of the cascade 1. Accordingly, the negative half-wave enters the circuit at a voltage variation speed $du_o/dt$, such that the depletion-layer capacitance $C_1$ belonging to the thyristor $T_1$ charges, and the current through the thyristor $T_1$ assumes the value of the breakover current $i_k$. The breakover current $i_k$ then flows to the thyristor $T_2$, where it charges the depletion-layer capacitance $C_1$ and ground capacitance $C_2$ that are present there. The breakover current $i_k$ ensues for the thyristor $T_2$ as well. This process is repeated for the subsequent transistors $T_3$–$T_n$, and the current arriving from the stage ($T_{n-1}$) of the cascade before the thyristor $T_n$ causes charging of the mutually parallel capacitances of the output-side stage (thyristor $T_n$). The total capacitance of the last stage is thus the sum of the depletion-layer capacitance $C_1$ and ground capacitance $C_2$ of the thyristor $T_n$. Compared with the other stages of the cascade 1, this total capacitance is the highest capacitance, since there is no series circuit of capacitances in the last stage. It is acted upon by the voltage variation speed $du_o/dt$, which leads to the development of the displacement current $i_{ver}$.

In summary, the total breakover voltage is precisely the sum of the individual breakover voltages $u_K$ of the various semiconductors of the cascade 1, so that variations from one component to another have no deleterious effect. The overall resultant symmetrical voltage distribution without additional wiring elements means that all the thyristors $T_1$–$T_n$ are turned on virtually simultaneously when the ignition voltage is reached.

The invention will now be described in still further detail, using a numerical example:

Let it be assumed that the sum of the depletion-layer capacitance $C_1$ and the ground capacitance $C_2$ is 1 pF. The speed of voltage increase $du_o/dt$ is specified as 1000 F/μs. For a factor a=5, the following relationships then obtain:

$$i_k > 1 \text{ mA}$$

$$i_k < 5 \text{ mA}.$$

Thus as long as the breakover current $i_k$ is in the range between 1 and 5 Ma, a substantially symmetrical distribution of the cascade input voltage (operating voltage $u_o$) among the various stages of the cascade 1 can be assumed to occur. In developing the semiconductor components for the circuit arrangement described in the example here, measures well known to one skilled in the art should accordingly be taken to assure that the breakover current $i_k$ is within the range from 1 to 5 mA.

We claim:

1. A semiconductor switch adapted for use as an ignition voltage switch for applying an ignition voltage to a spark plug of an internal combustion engine, having a cascade circuit formed of series-connected semiconductor components ($T_1$–$T_n$) for connecting an operating voltage $u_o$ through to a load, wherein the semiconductor components each have a depletion-layer capacitance ($C_1$), and said series connection existing between each two semiconductor components forms a parasitic ground capacitance ($C_2$) determined by the distribution of an electrical field generated by current flow through said series-connected semiconductor components, characterized in that a breakover current $i_k$ flowing through the semiconductor components ($T_1$–$T_n$), prior to attainment of a conductive state by said semiconductor components, has a value which falls, relative to a displacement current $i_{ver}$, within the range $$i_{ver} < i_k < a \cdot i_{ver},$$

wherein said factor a has a value between 5 and 10, and said displacement current is brought about by a voltage increase ($du_o/dt$) in the operating voltage $u_o$ at the charge state, successively varying with the switching of the semiconductor components, of the depletion-layer and ground capacitance of the cascade circuit, and wherein said semiconductor components are so dimensioned that resulting values of said depletion-layer capacitance and said parasitic ground capacitance ($C_1$,$C_2$) confine the relative values of $i_k$ and $i_{ver}$ to the range set forth in the aforementioned equation.

2. The semiconductor switch of claim 1, wherein the voltage increase ($du_o/dt$) ensues up to an ignition voltage ($U_{ko}$), of the semiconductor components ($T_1$–$T_n$), that makes the semiconductor component conducting.

3. The semiconductor switch of claim 1, wherein the semiconductor components have control terminals (gates 6), and turning-on of the semiconductor components is effected by triggering of the control terminals (gates 6).

4. The semiconductor switch of claim 1, wherein the breakover current $i_k$ is defined upon the manufacture of each semiconductor component ($T_1$–$T_n$).

5. The semiconductor switch of claim 1, wherein each semiconductor component ($T_1$–$T_n$) is a component selected from the group consisting of a thyristor, a photothyristor, an integrated photo circuit, and a trigger diode.

6. The semiconductor switch of claim 2, wherein the semiconductor components have control terminals, (gates 6), and turning-on of the semiconductor components is effected by triggering of the control terminals (gates 6).

7. The semiconductor switch of claim 2, wherein the breakover current $i_k$ is defined upon the manufacture of each semiconductor component ($T_1$–$T_n$).

8. The semiconductor switch of claim 3, wherein the breakover current $i_k$ is defined upon the manufacture of each semiconductor component ($T_1$–$T_n$).

9. The semiconductor switch of claim 6, wherein the breakover current $i_k$ is defined upon the manufacture of each semiconductor component ($T_1$–$T_n$).

10. The semiconductor switch of claim 2, wherein each semiconductor component ($T_1$–$T_n$) is a component selected from the group consisting of a thyristor, a photothyristor, an integrated photo circuit, and a trigger diode.

11. The semiconductor switch of claim 3, wherein each semiconductor component ($T_1$–$T_n$) is a component selected from the group consisting of a thyristor, a photothyristor, an integrated photo circuit, and a trigger diode.

12. The semiconductor switch of claim 4, wherein each semiconductor component ($T_1$–$T_n$) is a component selected from the group consisting of a thyristor, a photothyristor, an integrated photo circuit, and a trigger diode.

13. The semiconductor switch of claim 6, wherein each semiconductor component ($T_1$–$T_n$) is a component selected from the group consisting of a thyristor, a photothyristor, an integrated photo circuit, and a trigger diode.

14. The semiconductor switch of claim 7, wherein each semiconductor component ($T_1$–$T_n$) is a component selected from the group consisting of a thyristor, a photothyristor, an integrated photo circuit, and a trigger diode.

15. The semiconductor switch of claim 8, wherein each semiconductor component ($T_1$–$T_n$) is a component selected from the group consisting of a thyristor, a photothyristor, an integrated photo circuit, and a trigger diode.

16. The semiconductor switch of claim 9, wherein each semiconductor component ($T_1$–$T_n$) is a component selected from the group consisting of a thyristor, a photothyristor, an integrated photo circuit, and a trigger diode.

* * * * *